US009574385B2

(12) United States Patent
McKibben et al.

(10) Patent No.: US 9,574,385 B2
(45) Date of Patent: Feb. 21, 2017

(54) DOOR ACTUATOR

(71) Applicant: Schlage Lock Company LLC, Indianapolis, IN (US)

(72) Inventors: Aaron Patrick McKibben, Fishers, IN (US); Brian Christopher Eickhoff, Danville, IN (US)

(73) Assignee: Schlage Lock Company LLC, Indianapolis, IN (US)

( * ) Notice: Subject to any disclaimer, the term of this patent is extended or adjusted under 35 U.S.C. 154(b) by 0 days.

(21) Appl. No.: 14/606,629

(22) Filed: Jan. 27, 2015

(65) Prior Publication Data

US 2015/0135601 A1 May 21, 2015

Related U.S. Application Data

(62) Division of application No. 13/243,666, filed on Sep. 23, 2011, now Pat. No. 8,938,912.

(Continued)

(51) Int. Cl.

*E05F 1/12* (2006.01)
*E05F 1/10* (2006.01)

(Continued)

(52) U.S. Cl.

CPC ..... *E05F 1/1246* (2013.01); *E05F 1/10* (2013.01); *E05F 1/105* (2013.01); *E05F 3/00* (2013.01); *E05F 3/227* (2013.01); *E05F 3/104* (2013.01); *E05Y 2201/412* (2013.01); *E05Y 2201/42* (2013.01); *E05Y 2201/638* (2013.01); *E05Y 2800/205* (2013.01); *E05Y 2800/22* (2013.01);

(Continued)

(58) Field of Classification Search

CPC ..... E05F 1/104; E05F 1/105; E05F 1/1066
See application file for complete search history.

(56) References Cited

U.S. PATENT DOCUMENTS 148,980 A 3/1874 Peyer
3,021,556 A * 2/1962 Pittenger ..... E05F 3/06 16/284

(Continued)

FOREIGN PATENT DOCUMENTS

CN 2072580 3/1991
CN 1392916 1/2003

(Continued)

OTHER PUBLICATIONS

International Search Report, PCT/US2012/026149, Jun. 8, 2012, 2 pages.

(Continued)

*Primary Examiner* — Brian Mattei
*Assistant Examiner* — Catherine A Kelly
(74) *Attorney, Agent, or Firm* — Taft Stettinius & Hollister LLP

(57) ABSTRACT

A power boost assembly is disclosed that can be used with a door actuator, such as a door closer. The power boost assembly is structured to store an energy during a first movement of a door and release the stored energy during a second movement of the door. In one form the power boost assembly can be structured as a module that can be added to an existing door and door closer installation. In one form the power boost assembly is used to increase a closing force imparted to a door to ensure a latching event.

20 Claims, 15 Drawing Sheets

Related U.S. Application Data

(60) Provisional application No. 61/445,419, filed on Feb. 22, 2011.

(51) Int. Cl.
*E05F 3/22* (2006.01)
*E05F 3/00* (2006.01)
*E05F 3/10* (2006.01)

(52) U.S. Cl.
CPC ..... *E05Y 2800/70* (2013.01); *E05Y 2900/132* (2013.01); *Y10T 16/27* (2015.01); *Y10T 16/293* (2015.01); *Y10T 16/56* (2015.01); *Y10T 16/593* (2015.01); *Y10T 29/49716* (2015.01)

(56) References Cited

U.S. PATENT DOCUMENTS

| | | | | |
|---|---|---|---|---|
| 3,487,494 | A | 1/1970 | De Baan et al. | |
| 4,045,914 | A | 9/1977 | Catlett | |
| 4,348,835 | A | 9/1982 | Jones et al. | |
| 4,387,482 | A | 6/1983 | Maublanc | |
| 4,669,147 | A | 6/1987 | Suchanek | |
| 4,763,384 | A | 8/1988 | Watabe | |
| 4,763,385 | A | 8/1988 | Furch et al. | |
| 4,935,989 | A | 6/1990 | Miller | |
| 5,016,317 | A | 5/1991 | Hung | |
| 5,020,189 | A * | 6/1991 | Grome | E05D 11/1064 16/286 |
| 5,239,778 | A | 8/1993 | Towler | |
| 5,243,735 | A * | 9/1993 | O'Brien, II | 16/64 |
| 5,535,514 | A | 7/1996 | Lucas | |
| 5,666,692 | A * | 9/1997 | Toledo | 16/80 |
| 5,682,644 | A | 11/1997 | Bohacik et al. | |
| 5,901,412 | A | 5/1999 | Jentsch | |
| 6,430,834 | B2 | 8/2002 | Myers et al. | |
| 6,442,795 | B1 * | 9/2002 | Chen | 16/53 |
| 6,625,847 | B1 | 9/2003 | Jones | |
| 6,681,444 | B2 | 1/2004 | Breed et al. | |
| 6,684,453 | B2 | 2/2004 | Wang | |
| 6,786,006 | B2 | 9/2004 | Kowalczyk et al. | |
| 6,886,217 | B2 | 5/2005 | Foster | |
| 7,007,341 | B2 * | 3/2006 | Wang | 16/60 |
| 7,356,878 | B2 | 4/2008 | Foster | |
| 7,516,680 | B2 | 4/2009 | Clingman et al. | |
| 7,748,080 | B2 * | 7/2010 | Hottmann | 16/72 |
| 7,774,899 | B2 | 8/2010 | Braunlich | |
| 7,788,786 | B2 | 9/2010 | Hewitt et al. | |
| 7,806,011 | B2 | 10/2010 | Eichenberger et al. | |
| 7,886,840 | B2 | 2/2011 | Young et al. | |
| 7,921,511 | B2 * | 4/2011 | Johnson | 16/60 |
| 7,934,754 | B2 | 5/2011 | Mathachan | |
| 8,181,311 | B2 * | 5/2012 | Chiang et al. | 16/78 |
| 8,286,306 | B2 * | 10/2012 | Vanini | 16/290 |
| 8,564,235 | B2 * | 10/2013 | Burris | E05F 3/22 318/400.37 |
| 8,793,838 | B2 | 8/2014 | McKibben et al. | |
| 8,938,912 | B2 | 1/2015 | McKibben et al. | |
| 2002/0026750 | A1 | 3/2002 | St. John et al. | |
| 2007/0256275 | A1 | 11/2007 | Winkler | |
| 2008/0196313 | A1 | 8/2008 | Fink et al. | |
| 2008/0318645 | A1 * | 12/2008 | Takamori et al. | 455/575.4 |
| 2010/0064472 | A1 * | 3/2010 | Busch | 16/80 |
| 2011/0030167 | A1 | 2/2011 | Chiang et al. | |
| 2013/0097805 | A1 * | 4/2013 | Bland et al. | 16/72 |
| 2015/0020350 | A1 | 1/2015 | McKibben et al. | |
| 2015/0135601 | A1 | 5/2015 | McKibben et al. | |

FOREIGN PATENT DOCUMENTS

| | | | | |
|---|---|---|---|---|
| DE | 19513435 | A1 | 10/1996 | |
| DE | 19526061 | | 1/1997 | |
| DE | 19526061 | A1 * | 1/1997 | E05F 3/104 |
| DE | 10031403 | A1 | 1/2002 | |
| EP | 0830491 | | 5/2001 | |
| EP | 1900897 | A1 | 3/2008 | |
| GB | 2292182 | | 2/1996 | |
| GB | 2479145 | A | 10/2011 | |
| GB | 2462633 | B | 1/2013 | |
| WO | 0042282 | | 7/2000 | |
| WO | 02/20928 | | 3/2002 | |
| WO | 2006035044 | A1 | 4/2006 | |
| WO | 2011021414 | A1 | 2/2011 | |
| WO | 2011121281 | A1 | 10/2011 | |

OTHER PUBLICATIONS

Chinese First Office Action, Chinese Patent Application No. 201280019644.4, Apr. 24, 2015, 12 pages.

Chinese Search Report, Chinese Patent Application No. 201280019644.4, Apr. 15, 2015, 2 pages.

Chinese Second Office Action; Chinese Patent Office (State Intellectual Property Office, PR China); Chinese Patent Application No. 201280019644.4; Jan. 5, 2016; 11 pages.

Chinese Decision of Rejection (no newly-cited art); Chinese Patent Office (State Intellectual Property Office, PR China); Chinese Patent Application No. 201280019644.4; Jul. 22, 2016; 13 pages.

* cited by examiner

DOOR ACTUATOR

CROSS REFERENCE TO RELATED APPLICATIONS

The present application is a divisional of U.S. patent application Ser. No. 13/243,666 filed Sep. 23, 2011, which claims the benefit of U.S. Provisional Application No. 61/445,419 filed Feb. 22, 2011. The disclosures of each of these applications are incorporated herein by reference.

TECHNICAL FIELD

The present invention generally relates to door and door hardware, and more particularly, but not exclusively, to door closer hardware. In one form the present invention relates to a system and method for boosting the closure force of an automatic door closer. More particularly in one form, but not exclusively, the invention relates to a system and method for boosting the closure force at the point of latching without significantly increasing the opening force.

BACKGROUND

Door closers are often attached to doors to assure that the door is closed after use. The American with Disabilities Act ("ADA") includes guidelines that relate to the manual operating force required to activate door hardware and manually open public doors. Specifically, the ADA requires that a manual operating force of 5 lbs or less is required to open interior and exterior doors.

Current mechanical closer design allows for closers to be set to require manual opening forces measuring between 3.75-4.75 lbs, depending on the application, door weight, and external environment. In some cases, this setting does not provide enough force to assure that the door latches in the closed position.

Some existing systems have various shortcomings relative to certain applications. Accordingly, there remains a need for further contributions in this area of technology.

SUMMARY

In one embodiment, the invention provides a door closer including a power boost assembly. The power boost assembly includes at least one energy storage assembly configured to store energy during door opening and uses the stored energy during door closure to assure that the door latches in the closed position. In another alternative and/or additional embodiment, the present invention is a unique modular device capable of being coupled with existing door and door closer installations.

Other aspects of the invention will become apparent by consideration of the detailed description and accompanying drawings.

DETAILED DESCRIPTION OF THE ILLUSTRATIVE EMBODIMENTS

Figure 1:
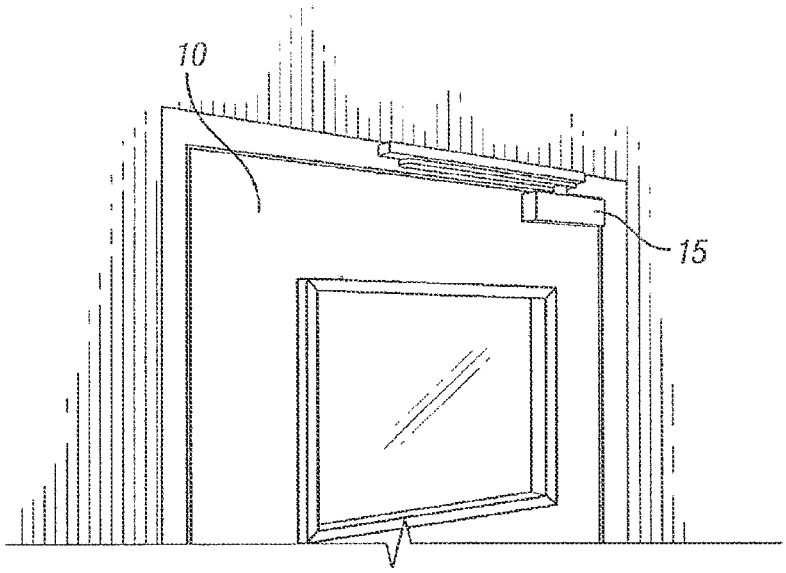
FIG. 1 is a depiction of a door including a door closer.

For the purposes of promoting an understanding of the principles of the invention, reference will now be made to the embodiments Illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

FIG. 1 illustrates a door 10 including a type of door closer 15. The closer 15 in the illustrated embodiment includes a rack and pinion mechanical closer design that can be adjustable to allow the opening force to be adjusted, such as, for example, to meet the ADA requirements. The closer 15 can take other door actuation forms and may or may not be adjustable. In some forms of the closer 15, including those forms that are adjustable, the closer 15 may not provide enough closing force to assure that the door 10 latches in the dosed position. For example, when the door closer 15 is configured and/or adjusted to meet an opening force requirement, such as the 5 lb maximum opening force requirement, insufficient return force may be produced by the closer 15 to properly close the door. The present application discloses various embodiments of a power boost assembly that can be used to provide a power boost to a door such as, for example, to supplement a closing force to the door.

Figure 2:
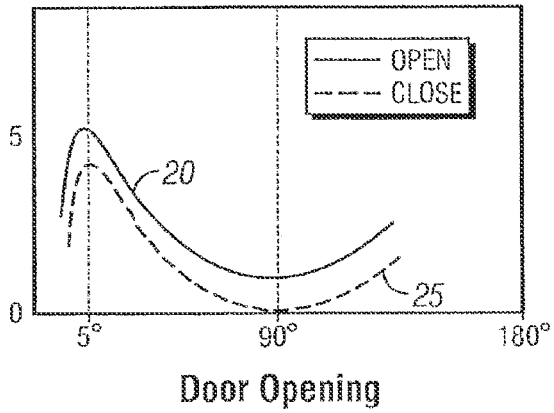
FIG. 2 PRIOR ART
FIG. 2 is a graph of force versus door opening angle for a typical door closer.
Figure 3:
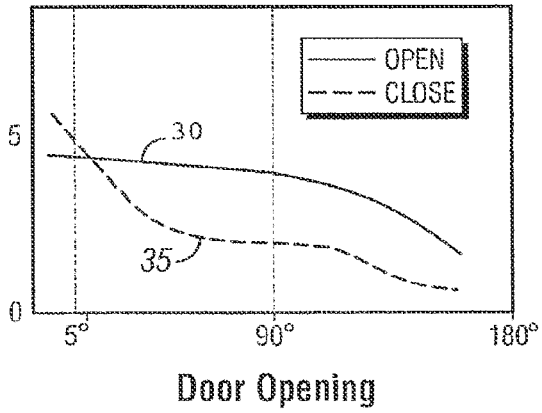
FIG. 3 is a graph of force versus door opening angle for a door closer including a power boost assembly.
Figure 2A:
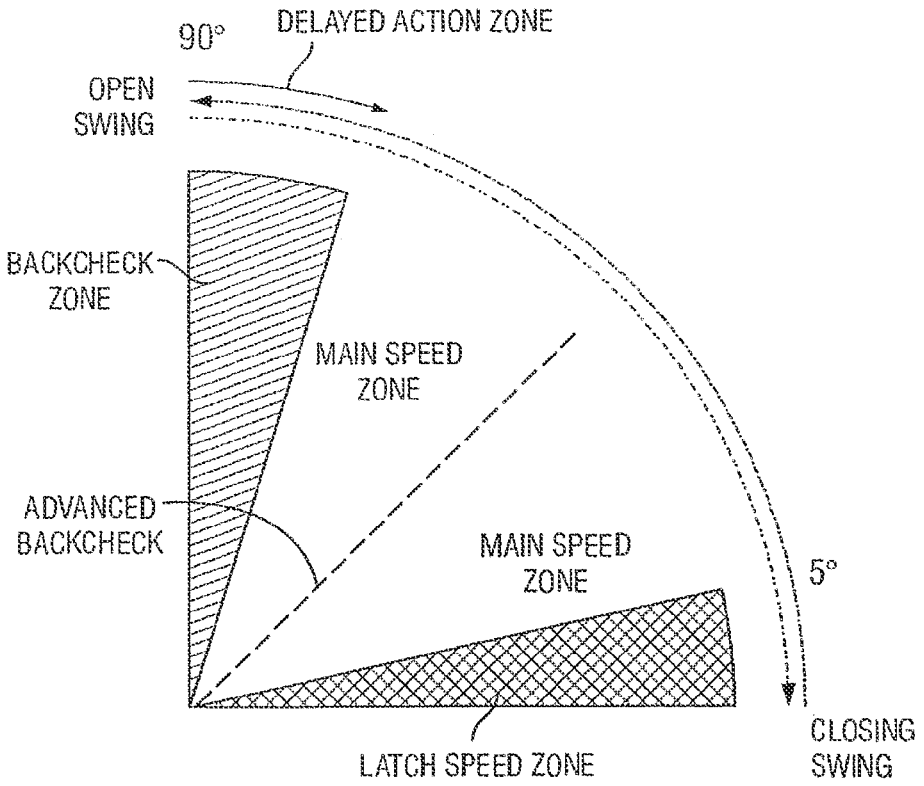
FIG. 2*a* is a schematic illustration of the regions of a door opening process.

FIGS. 2-3 provide illustrations of various characteristics of a door and door/door closer combinations. FIG. 2*a*, for example, illustrates one example of the swinging direction of a door and zones through which a door passes as it is open and closed. Though the illustration in FIG. 2*a* depicts a door swing over 90 degrees, some doors can have a larger or smaller swing and can have similar zones that may or may not occur over similar swing angles. FIG. 2 provides an illustration of a force versus door position curve for door opening 20 and door closing 25. As can be seen, the door closing force parallels the door opening force but is slightly reduced. Thus, less than 5 lbs of force is available during the last 5 degrees of door rotation when latching occurs. Under some conditions, the lower force available may not be sufficient to assure complete closing, such as a failure to provide a latching of the door. FIG. 3 illustrates a curve in which a device of the present application might provide that the force required to open the door 30 is increased slightly and that energy is harvested (or stored) to provide an increased force during closure 35 of the door 10. As can be seen, the closure force 35 from 5 degrees open to the dosed position is actually higher than the force required to open the door 30 through that same range. Other curves having a variety of other characteristics are also contemplated herein.

Figure 4:
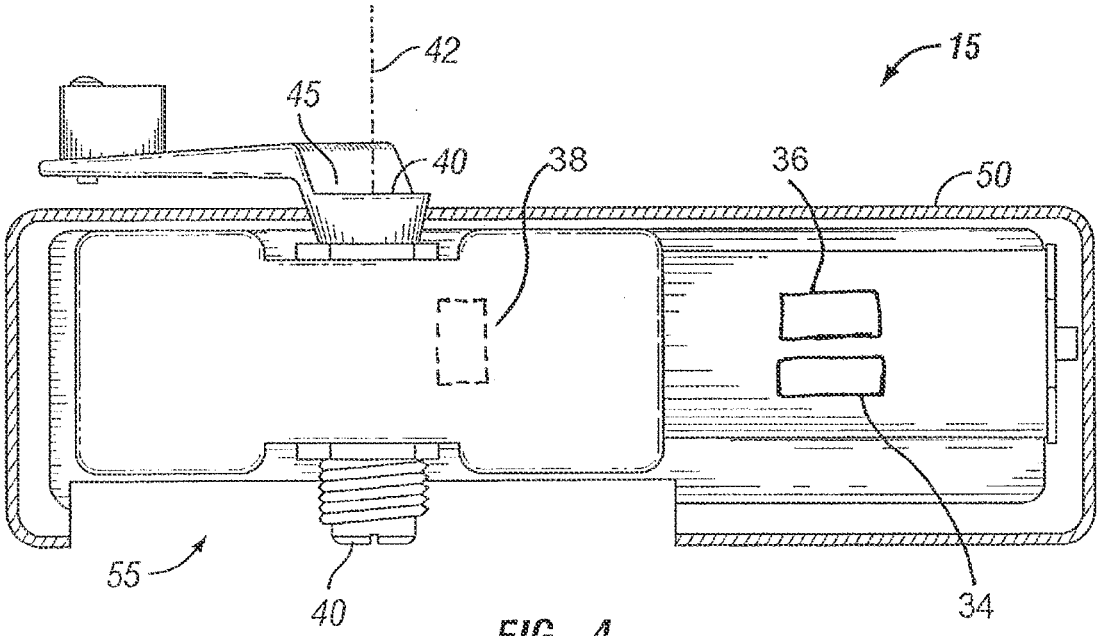
FIG. 4 is a side view of the door closer of FIG. 1 with a housing removed to show the internal components.

FIG. 4 illustrates an example of a door closer 15 of FIG. 1 showing the components internal to a housing 50. The closer 15 of the illustrated embodiment includes a rack 38 and pinion 40 arrangement that is connected to the door 10 via a linkage 45. The door closer 15 also includes a spring 34 and damper 36 arrangement. The spring 34 can be used to store energy during a door opening motion of the door and return the energy during a closing motion. Various types and arrangements of springs are contemplated for the door closer 15. The damper 36 can be a fluid type damper used to regulate the speed of door closure. Various types of dampers can be used.

Though the internal view of the door closer 15 does not shown an internal view of the rack and pinion arrangement, it will be appreciated that the pinion 40 rotates about an axis 42 as the door (not shown) is moved relative to the linkage 45. In some forms the linkage 45 is referred to as an arm and can take a variety of arrangements such as, but not limited to, a scissor arrangement. During opening, the linkage 45 rotates the pinion 40 about the axis 42 which drives the rack, or one or more cams in yet further embodiments of the closer, to compress a spring (also not shown). During closing, the energy stored in the spring moves the rack or the cams which in turn rotate the pinion 40. The rotation of the pinion 40 moves the linkage 45 and forces the door 10 toward the closed position.

The housing 50 covers the mechanical components of the illustrated embodiment which can be useful in some installations to conceal the door closer 15 during operation. In some embodiments the housing 50 need not be used or can be removed entirely if desired. The housing 50 can take the form of a unitary body that can be affixed to the door, but in can also take on other forms. For example, the housing 50 can be affixed, integrated, part of, etc. to the door closer 15 to set forth just one non-limiting alternative.

The door closer 15 of the illustrated embodiment is in form of a non-handed door closer which can be used for a variety of door and door closer configurations such as right and left handed doors. Embodiments of the present application described further below can be used with non-handed door closers but can also be used with single handed door closers. The non-handed door closer 15 includes a pinion 40 that protrudes from both a top and bottom of the door closer 15 such that it can be coupled with the linkage 45 regardless of its orientation as a right handed or left handed door closer.

In the arrangement of FIG. 4, a small space 55 is available beneath the pinion 40 and, when the housing 50 is used, within the housing 50. Though not necessary for the implementation of various embodiments of a power boost assembly (described further below) of the present application, some embodiments are designed to fit within the space 55. The space 55 can be used such that various embodiments of the power boost assembly described herein can be coupled with existing closers 15 without the need to replace the housing 50 or any other significant components. In some forms, the housing of the closer 15 can include a pocket into which the power boost assembly can be located. In these embodiments the power boost assembly can form a continuous bottom surface with the closer 15, but in some forms may be discontinuous. Of course, the design could be varied in a manner that would require a different housing 50 or a different component arrangement. In some forms the power boost assembly can be coupled to a pinion that is also coupled to the linkage 45, regardless of whether the door closer 15 is a non-handed closer. In short, the power boost assembly of the instant application can be attached at a variety of locations, in a variety of orientations, to a variety of objects such as the pinion.

Figure 5:
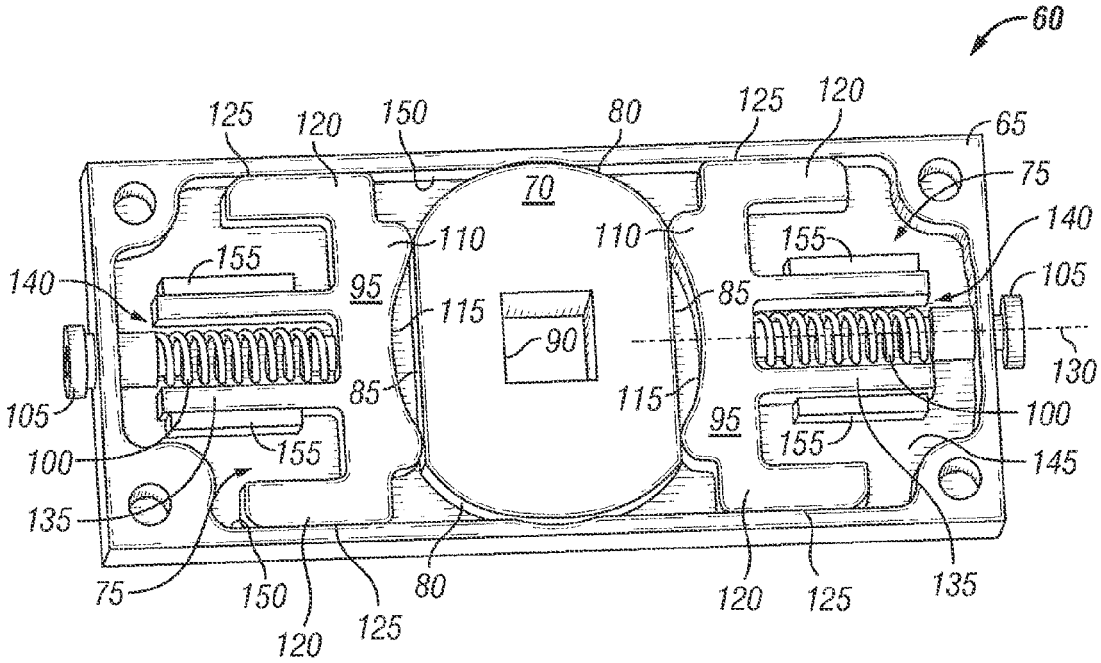
FIG. 5 is a perspective view of a power boost assembly arranged in a door closed position.

FIG. 5 illustrates one embodiment of a power boost assembly 60 of the present application that can be used with the door closer 15, and that in some forms is sized to fit within the space 55 illustrated in FIG. 4. The power boost assembly 60 can be used to store an energy along a portion of a movement of the door and then release the energy along another portion of a movement of the door. For example, the power boost assembly 60 can be used to store an energy when a door is opened and then release the energy when the door is closed, such as in some embodiments when the door is in a latch zone. The energy stored can occur over a first range of a movement of the door and then released over a second range. In the embodiment depicted in FIG. 5 the first range can be the same as the second range, but in other embodiments the energy storage range can be different than the energy release range.

The power boost assembly 60 of the embodiment depicted in FIG. 5 includes a base 65, a center cam 70, and two energy storage assemblies 75. The center cam 70 in the illustrated embodiment is substantially planar and includes an outer perimeter that includes two circular portions 80 and two linear portions 85. The circular portions 80 can be a constant radius in some forms. A central aperture 90 is formed in the cam 70 and is sized and shaped to engage the pinion 40 such that rotation of the pinion 40 produces a corresponding rotation of the center cam 70. As will be understood by one of ordinary skill in the art, other perimeter shapes are possible and could be used to arrive at different closing force curves.

Each of the energy storage assemblies 75 includes a closing cam 95, a spring 100, and an adjustment member 105. The closing cam 95 includes a head portion 110 that includes a cam receiving surface 115 and two arms 120. The cam receiving surface 115 includes a concave circular perimeter sized to receive one of the circular portions 80 of the center cam 70. The arms 120 are disposed on opposite sides of the closing cam 95 and define two opposite parallel guide surfaces 125 that operate to guide the motion of the closing cam 95 along a reciprocation axis 130.

A guide portion 135 extends from the head portion 110 along the reciprocation axis 130 and defines a spring chamber 140. The spring 100 is positioned within the spring chamber 140 and operates to bias the closing cam 95 toward the center cam 70 along the reciprocation axis 130. Though the spring 100 is shown as a helical coil spring, other types of devices can also be used whether of the spring type or otherwise. The adjustment member 105 engages one end of the spring 100 and is movable along the reciprocation axis 130 to adjust the biasing force produced by the spring 100. In the illustrated construction, the adjustment member 105 includes a screw that can be rotated to adjust the size of the space in which the spring 100 is disposed, with a reduction in space producing an increased biasing and closure force. Other configurations for the adjustment member 105 can also be used.

The base 65 includes a substantially rectangular plate portion having a recessed region 145 sized to retain and receive the center cam 70, and a portion of the energy storage assemblies 75. The guide surfaces 125 of the closing cams 95 engage parallel side surfaces 150 of the base 65 to guide the reciprocation of the closing cams 95. In addition, two pairs of guide rails 155 are formed in the base 65 with each pair 155 positioned to receive the guide portion 135 of the respective closing cam 95 to further guide the closing cam 95.

The base 65 of the illustrated embodiment attaches to the existing door closer 15 and fits within the available space 55 to provide a power boost during door closure. In the illustrated construction, threaded fasteners attach the base 65 to the door closer 15 with other attachment arrangements being possible. The threaded fasteners can take the form of screws and bolts. Other arrangements include snaps, straps, and rivets, to set forth just a few examples.

With reference to FIGS. 5-9, the operation of the power boost assembly 60 will now be described. FIG. 5 illustrates the power boost assembly 60 when the door 10 is in the closed position. In this position, the closing cams 95 rest on the linear portions 85 of the center cam 70 and the springs 100 are in their most relaxed position.

Figure 6:
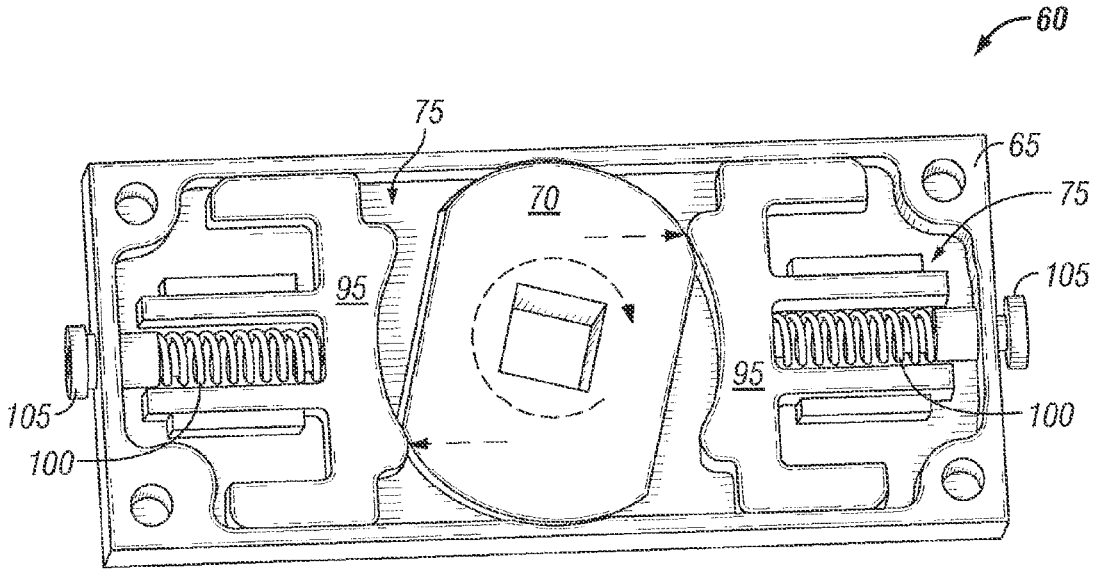
FIG. 6 is a perspective view of the power boost assembly of FIG. 5 arranged in a door opened 15 degrees position during opening.
Figure 7:
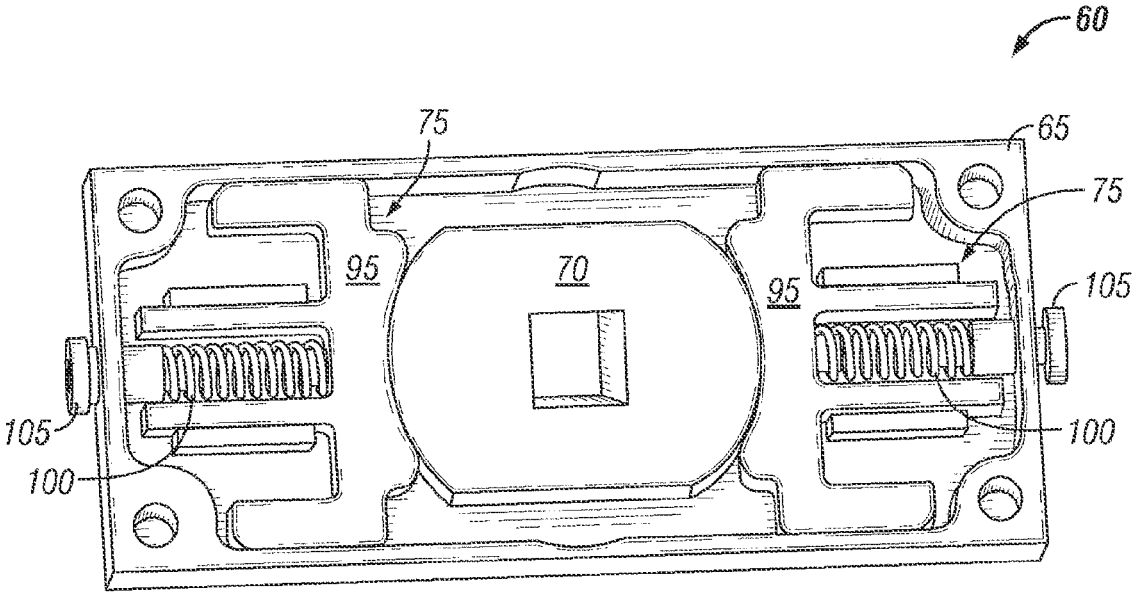
FIG. 7 is a perspective view of the power boost assembly of FIG. 5 arranged in a door opened 90 degrees position.

As the door 10 rotates, it passes through 15 degrees of rotation as illustrated in FIG. 6. During this rotation of the door 10, the center cam 70 displaces both closing cams 95 axially away from the center cam 70 until the circular portions 80 of the center cam 70 engage the cam receiving surface 115 of the closing cams 95. The displacement of the closing cams 95 compresses the springs 100 and stores energy within the springs 100. Though the illustrated embodiment is depicted as compressing the springs 100 through the first 15 degrees of rotation, other embodiments of the power boost assembly 60 can be configured to compress the springs 100 through a variety of other rotations.

Further rotation of the door 10 past the 15 degrees of rotation to 90 degrees (FIG. 7) and beyond does not further compress the springs 100 as the circular portions 80 of the center cam 70 ride within the cam receiving surfaces 115 of the closing cams 95. Thus, very little additional force is required to open the door 10 when the power boost assembly 60 is attached to the door closer 15.

Figure 8:
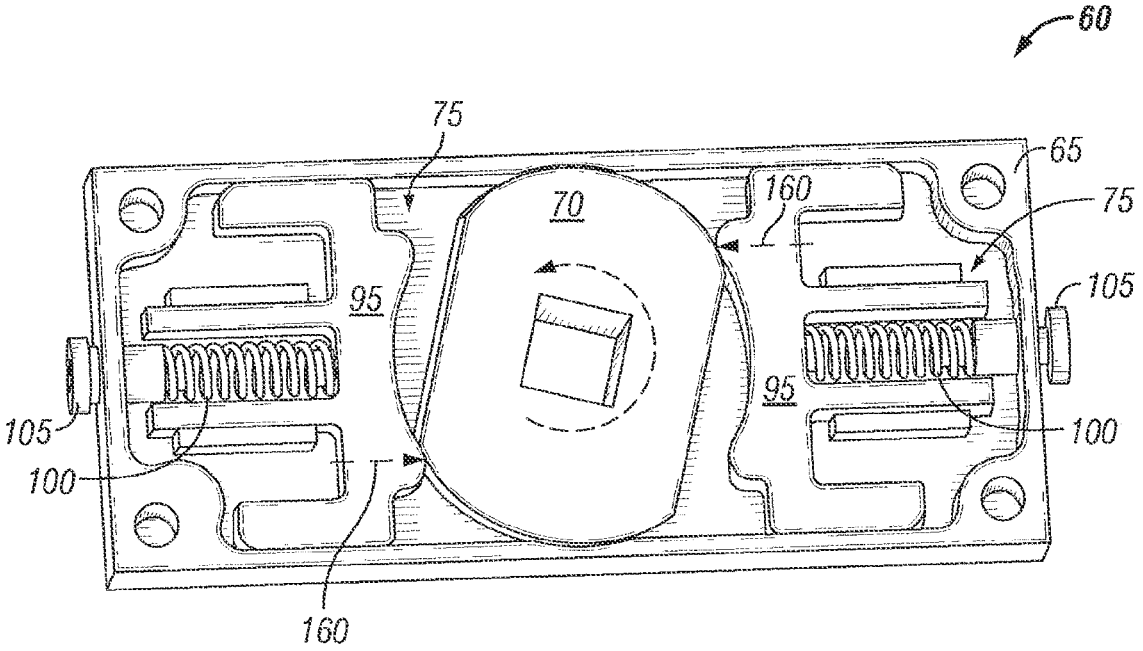
FIG. 8 is a perspective view of the power boost assembly of FIG. 5 arranged in a door opened 15 degrees position during closing.
Figure 9:
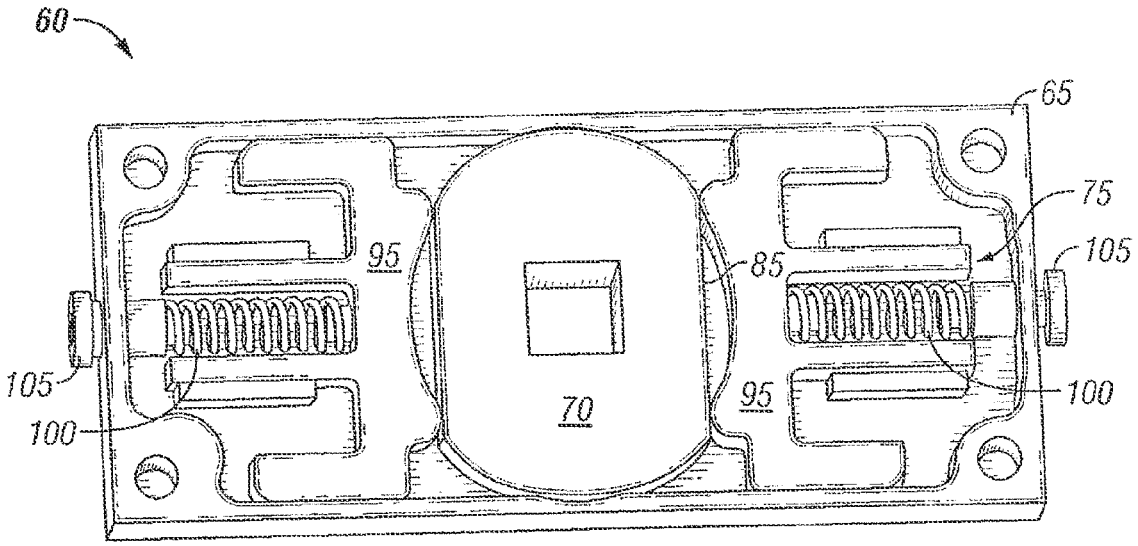
FIG. 9 is a perspective view of the power boost assembly of FIG. 5 arranged in a door dosed position.

During door closure, the center cam 70 rotates in the opposite direction until the door 10 reaches 15 degrees open as illustrated in FIG. 8. The power boost assembly 60 does not add any closure force to the door 10 until the door 10 reaches the position illustrated in FIG. 8. As the door 10 moves from the position of FIG. 8 to the closed position illustrated in FIG. 9, the center cam 70 rotates to a position at which the circular portions 80 no longer engage the closing cams 95 and the linear portions 85 begin to engage the center cam 70. The springs 100 force the closing cams 95 toward the center cam 70 during this rotation and apply a force 160 to the center cam 70. The force 160 produces a torque in the close direction which increases the closure force as the door 10 rotates between 15 degrees and 0 degrees (closed).

The present application provides a modular product 60 in all of its embodiments described above and below that can be attached to the pinion 40 on a standard rack and pinion closer 15 that mechanically stores energy during the opening/closing cycle of a door closure and uses that energy to provide a mechanical assistance ("power boost") during the latch portion of a closure. It will have already been appreciated that the power boost assembly can be used and/or configured to be used in any variety of door closer designs whether of the standard rack and pinion closer designs. Whichever the type of door actuation, the power boost assembly 60 of the present application can result in a more efficient and level power curve that best utilizes the forces within a door closer 15. In some forms the power boost assembly 60 can be integrated with or within the door closer to be sold as a unit, whether easily separated or not, or as a package that can be assembled with the door closer to be used in a door installation.

The power boost assembly 60 illustrated herein, as well as the illustrated door closer 15 is entirely mechanical. However, the internal component design could be executed in multiple ways. The illustrated construction utilizes a balanced cam style symmetrical design, but gears and asymmetrical designs could also be utilized to generate an additional added force once the closer 15 is near the latch position.

Designing an asymmetrical cam type component could potentially allow the energy and force to be harnessed along the opening of the closer 15 over a level power curve and redistribute that energy upon closing at a different point over the power curve. This would allow the user to retract the spring without exerting as much force as would be required to close.

The illustrated design includes a uniform cam 70 that spins in both directions with rotation of the pinion 40. A clutch style design would allow the pinion 40 to move freely during opening of the door 10, thereby requiring no additional opening force, but as the closer 15 begins to close, a one direction clutch would wind the spring/assistance and then apply that collected energy once it reaches the latch position of the door 10.

In another arrangement, the interior design collects and stores energy using an entirely different mechanical design. Utilizing gears and adjusting the gear ratio could potentially perform the same intended result but in a different mechanical design.

Figure 10:
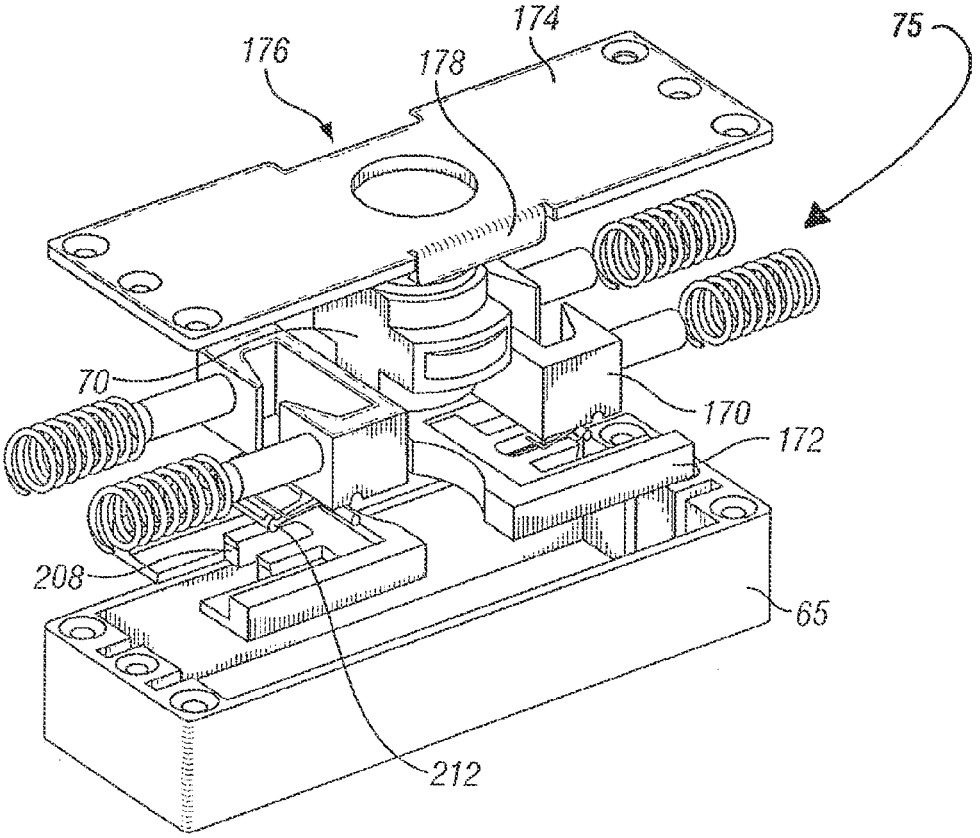
FIG. 10 is a view of yet another embodiment of a power boost assembly.

Another embodiment of a power boost assembly 60 is shown in FIGS. 10-26. Turning first to FIG. 10, a view depicting components of the power boost assembly 60 shows a base 65, center cam 70, energy storage assemblies 75, as well as a boost cam 170 and slide cam 172 that movingly interact upon rotation of the center cam 70. A force can be received by the energy storage assemblies 75 through the boost cam 170 over a motion of the center cam 70 and delivered from the energy storage assemblies 75 through the slide cam 172 over a subsequent motion of the center cam 70. As will be described below, the boost cam 170 and slide cam 172 are independently movable over a motion of the center cam 70 and are coupled to move together thereafter. In the illustrated embodiment the boost cam 170 and slide cam 172 are coupled to be moved together over a different range of motion of the center cam 70 than the range of motion associated with their independent movement. The range of motion can be, but is not limited to being determined on the basis of different directions of door swing.

A cover 174 is also used in the illustrated embodiment which includes an aperture 176 through which a device such as, but not limited to, the pinion 40 can be cooperatively engaged with the center cam 70. In one embodiment the cover 174 can be produced from a stamping operation and in the illustrated embodiment includes a number of apertures through which one or more fasteners can pass to couple the cover 174 to the base 65. The cover 174 can be fastened using a variety of techniques such as a threaded fastener, rivet, snap, straps, etc. Any variety of other forms of attachment are contemplated to couple the cover 174 to the base 65. The apertures through which fasteners can be used to couple the cover 174 to the base 65 can also be the same apertures used to couple the power boost assembly 60 to the door closer 15, but it will be appreciated that different apertures can perform the different tasks. The cover 174 can also include an aperture through which the pinion 40 or other device can be passed to couple to the center cam 70, as shown by the central aperture formed in the cover 174 of the illustrated embodiment. The cover 174 can also include flanges 178 that can be used to align the cover 174 to the base 65 prior to fastening. In addition, though the cover 174 is depicted as a substantially planar device, the cover 174 can be any configuration suitable to enclose various components of the power boost assembly 60.

Figure 11A:
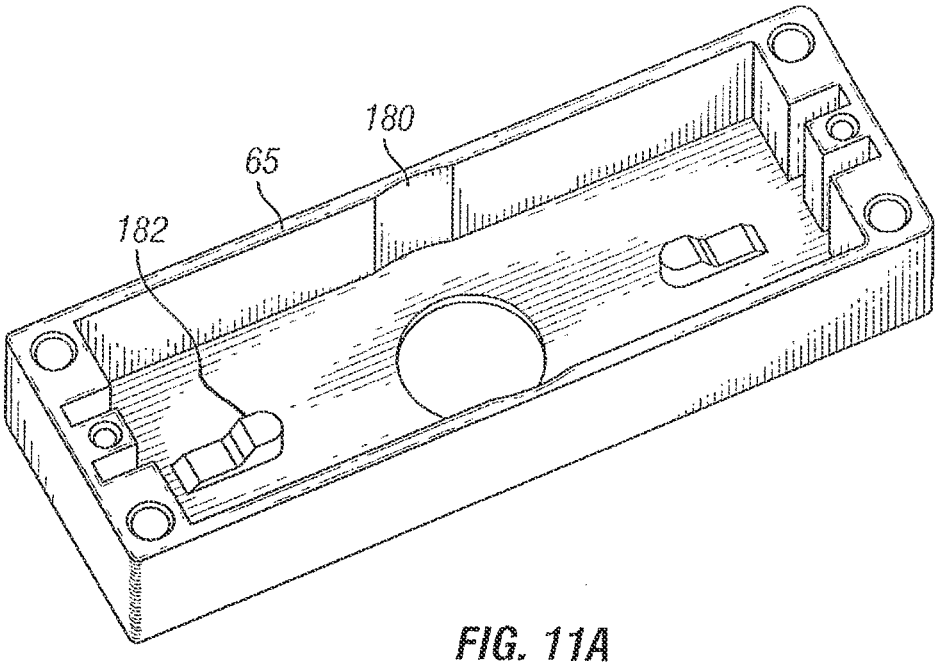
FIG. 11*a* is a view of an embodiment of a base.
Figure 11B:
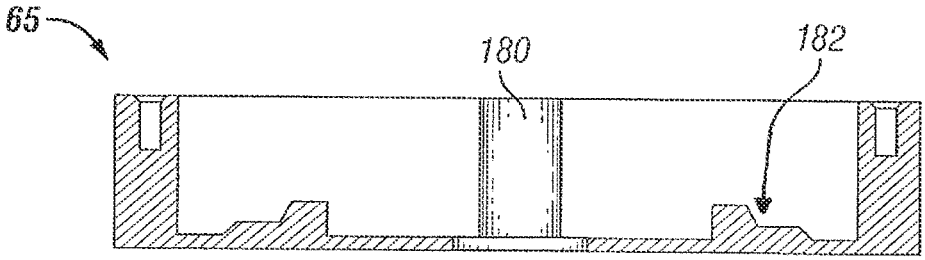
FIG. 11*b* is a view of an embodiment of a base.

With continuing reference to FIG. 10, FIGS. 11*a* and 11*b* depict views of the base 65 showing additional details. The base 65 is shown as including various sides within which can be found the various components of the power boost assembly 60, but in some forms the various sides can be incorporated into the cover 174. In some embodiments the base 65 can be substantially planar and the cover 174 can have various sides. Any various portion(s) of the base 65 and/or cover 174 can be used to couple to the door closer 15 and/or the door. In the illustrated embodiment, the base 65 also includes an aperture through which the pinion 40 or other device can be passed to couple to the center cam 70. Thus, in some embodiments the power boost assembly 60 can be integrated with a door closer or other suitable device through either the base 65 or the cover 174. In some forms the power boost assembly 60 need not be fully enclosed by virtue of the cover 174, base 65, or the combination thereof. The various components described herein can be integrated wholly with the base 65 or cover 174, and in some embodiments certain component(s) can be integrated with the base 65 while other(s) are integrated with the cover 174. Thus, in some embodiments the base 65 and cover 174 can serve as an integrated enclosure, whether completely enclosed or not, for retaining the various components of the power boost assembly 60. The base 65 can include formations 180 in its sides to permit rotation of the center cam 70. The base 65 can also include a trigger 182 that can be used to decouple the boost cam 170 and slide cam 172 discussed further below. One or more surfaces, protrusions, or other structure formed in or attached to the base 65 can be used to slidingly receive the slide cam 172 and/or boost cam 170. Furthermore, the base can also include provisions to provide a mechanical stop to movement of either or both the boost cam 170 and/or slide cam 172.

Figure 12A:
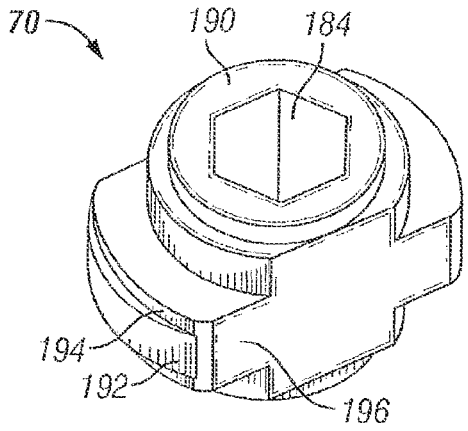
FIG. 12*a* is a view of an embodiment of a center cam.
Figure 12B:
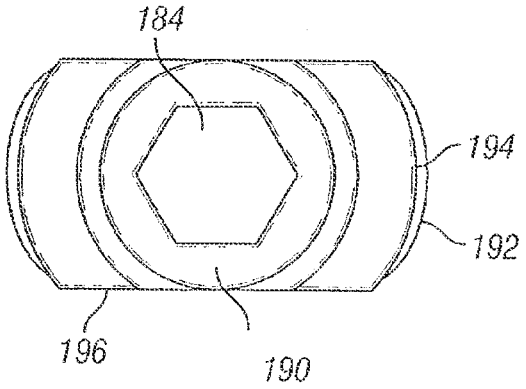
FIG. 12*b* is a view of an embodiment of a center cam.
Figure 12C:
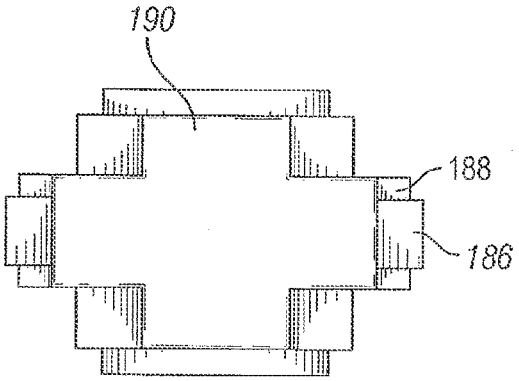
FIG. 12*c* is a view of an embodiment of a center cam.

FIGS. 12*a*, 12*b*, and 12*c* illustrate various views of an embodiment of the center cam 70 which is used to communicate power between components of the power boost assembly 60 and the door 10 and/or door closer 15. The center cam 70 in the illustrated embodiment is rotated about an axis and includes surfaces that are configured to interact with both the boost cam 170 and the slide cam 172 through respective interferences. The center cam 70 can be rotated by interaction with a pinion of the door closer 15, but other configurations, techniques, etc. are contemplated to impart a motion to the center cam 70 by virtue of movement of either or both the door closer 15 and the door 10. The center cam 70 in the illustrated embodiment includes an opening 184 through which a pinion can be received, but other embodiments may include a protrusion that is receive by a pinion or intermediate structure, among a variety of other approaches.

In the Illustrated embodiment the center cam 70 includes a boost cam engagement member 186 and a slide cam engagement member 188, each of which interact with corresponding cam follower surfaces on the boost cam 170 and slide cam 172, respectively. The boost cam engagement member 186 and the slide cam engagement member 188 are each shown as taking the form of a protrusion that extends from a body 190 of the center cam 70. Each of the members 186 and 188 include curved portions 192 and 194 which can take a variety of forms and in the illustrated embodiment are constant radius surfaces, but a variety of other surface configurations can be used. The constant radius, however, need not be measured from a constant origin. For example, the curved portion 192 can include a constant radius as measured from an origin offset from an origin of a constant radius surface of portion 194. The circumferential reach of each of the members 186 and 188 around the periphery of the center cam 70 can vary between various embodiments. In short, the protrusions can take a variety of shapes, orientations, geometries, etc. A side 196 is oriented to movingly engage the boost cam 170 and slide cam 172 until such position that the members 186 and 188 are rotated Into contact with the center cam 70. The curved portions 192 and 194 thereafter engage either or both the boost cam 170 and slide cam 172. In some embodiments having a constant radius curved portions, the engagement of the portions and the cams 170 and 172 may lead to little to no movement of the cams relative to the axis of rotation of the center cam 70 and in response to movement of the center cam 70 owing to the constant radius surface. However, the cams 170 and 172 will move In the illustrated embodiment when the side 196 is rotatingly in contact with the cams, more of which will be discussed below.

Figure 13A:
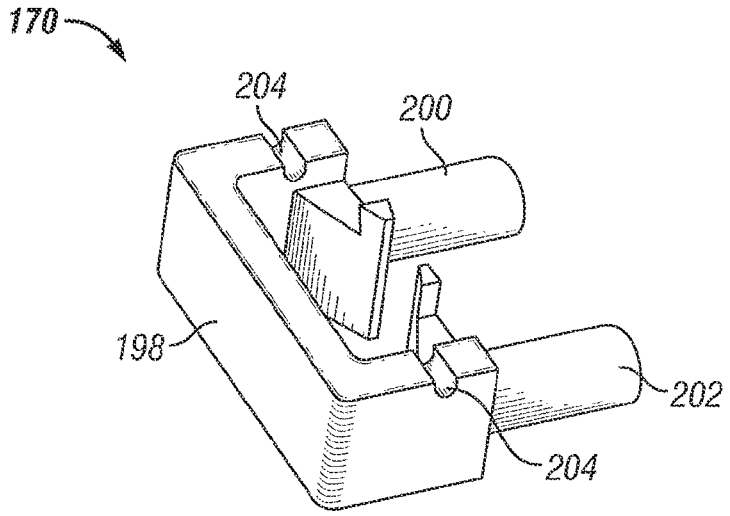
FIG. 13*a* is a view of an embodiment of a boost cam.
Figure 13B:
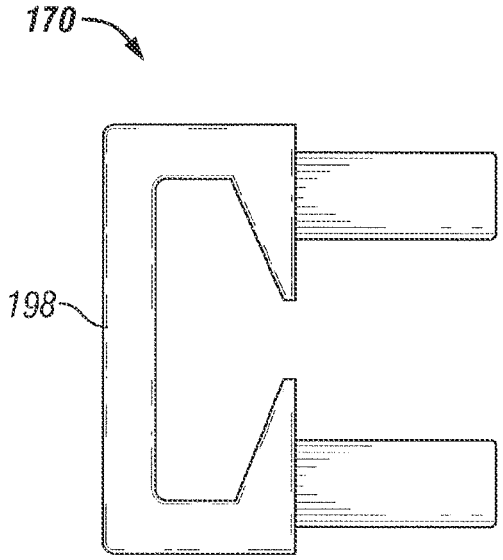
FIG. 13*b* is a view of an embodiment of a boost cam.
Figure 13C:
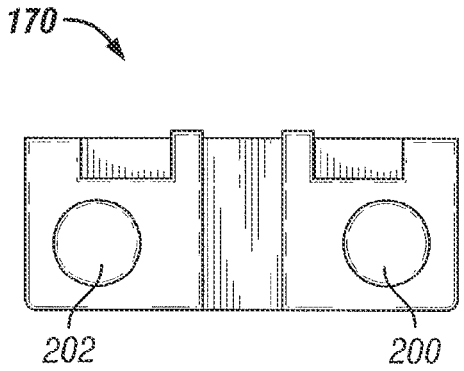
FIG. 13*c* is a view of an embodiment of a boost cam.

Turning now to FIGS. 13*a*, 13*b*, and 13*c*, the boost cam 170 of the illustrated embodiment is in the shape of a "C" and includes a boost surface 198 that is used to interact with the boost cam engagement member 186 of the center cam 70. Other shapes of the boost cam 170 are also contemplated herein. The interaction between the side 196 and boost cam engagement member 186 with the boost surface 198 of the illustrated embodiment determines the motion of the boost cam 170 in the presence of rotation of the center cam 70. For example, when a corner of the protrusion 186 engages the boost surface 198, movement of the boost cam 170 relative to the rotation axis of the center cam 70 can be accomplished. When, however, the curved portion 192 engages the boost surface 198, relatively little movement may occur when compared to engagement with a corner of the protrusion 186. In some forms no relative movement may occur if, for example, the curved portion 192 is a constant radius surface relative to a center of rotation of the center cam 70. The boost surface 198 is depicted as planar in the illustrated embodiment, but can take a variety of different shapes in other embodiments.

The boost cam 170 also includes posts 200 and 202 that extend from the boost cam 170 used to provide a surface over which springs 100 can be guided. The posts 200 and 202 can be integral with the boost cam or coupled thereto. The posts 200 and 202 are shown as circular in shape in the illustrated embodiment but can take different shapes in other embodiments. Though the illustrated embodiment is shown as including two posts 200 and 202, other embodiments can include any of a number of posts. Additionally and/or alternatively, devices other than the posts 200 and 202 can be used to guide the springs 100. Regarding the springs 100 as well as other components of the power boost assembly 60, variations in one embodiment described herein are equally applicable to other embodiments unless stated to the contrary. Thus, and as above, though the spring 100 is shown as a helical coil spring, other types of devices can also be used whether of the spring type or otherwise. To set forth just one non-limiting embodiment, an elastomeric material could be used to store energy.

As mentioned above, the boost cam 170 can be coupled to the slide cam 172 over a range of motion of the center cam 70. In the illustrated embodiment the boost cam 170 includes a mechanism that permits the boost cam 170 to be movingly coupled with the slide cam 172. In the embodiments described below the boost cam 170 is coupled with the slide cam 172 via a spring loaded latch that is biased in a direction to engage a catch that moves with the slide cam 172. One form of the spring loaded latch can be seen in FIG. 10. In one form the spring loaded latch is rotatable about an axis and pivots about a pin. The pin is formed to ride within the formation 204 and will be shown below in more detail.

Figure 14A:
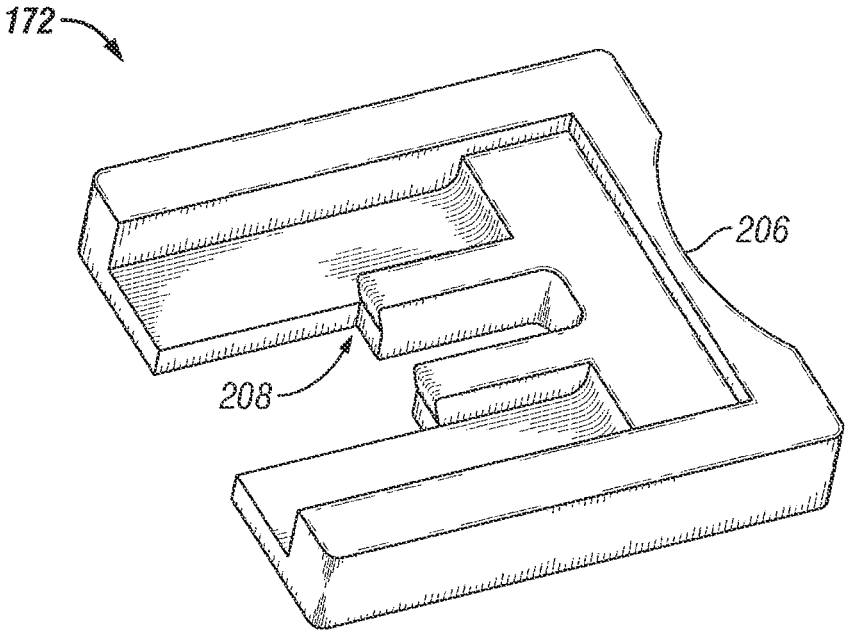
FIG. 14*a* is a view of an embodiment of a slide cam.
Figure 14B:
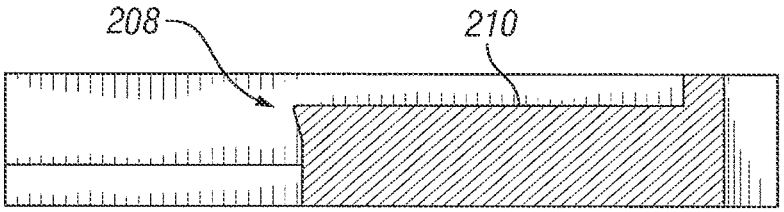
FIG. 14*b* is a view of an embodiment of a slide cam.
Figure 15A:
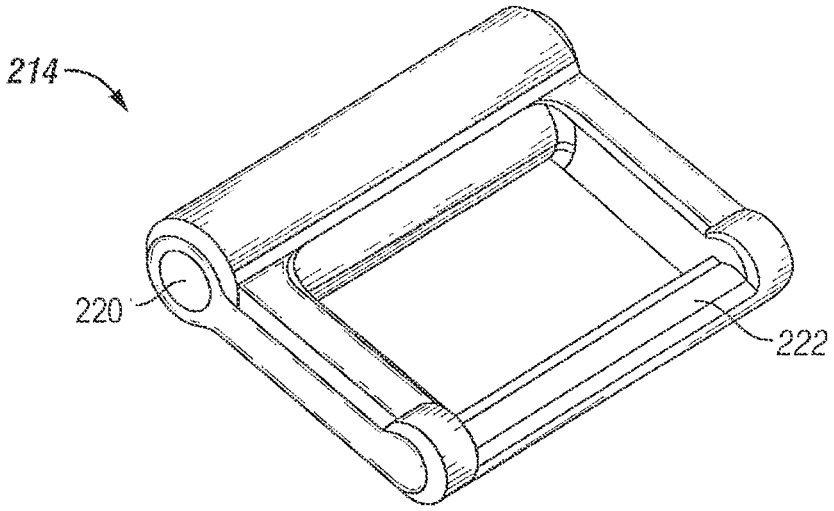
FIG. 15*a* is a view of an embodiment of a latch.
Figure 15B:
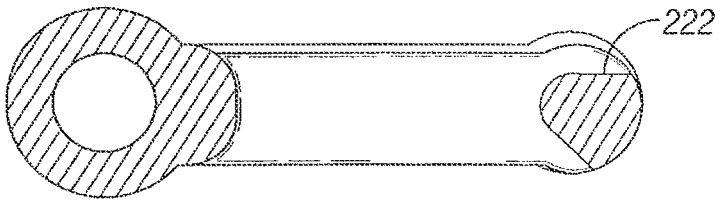
FIG. 15*b* is a view of an embodiment of a latch.
Figure 16:
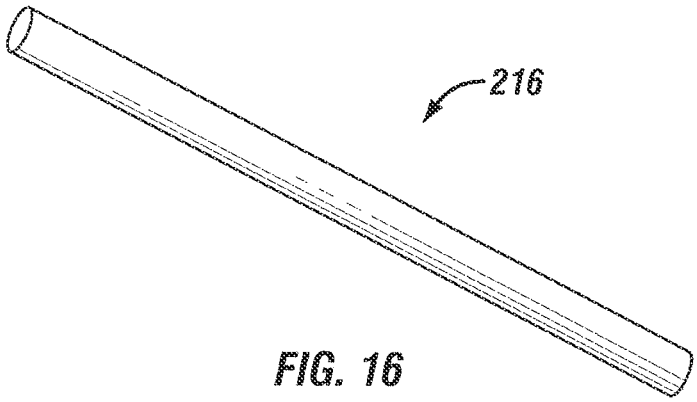
FIG. 16 is a view of an embodiment of a pin.
Figure 17:
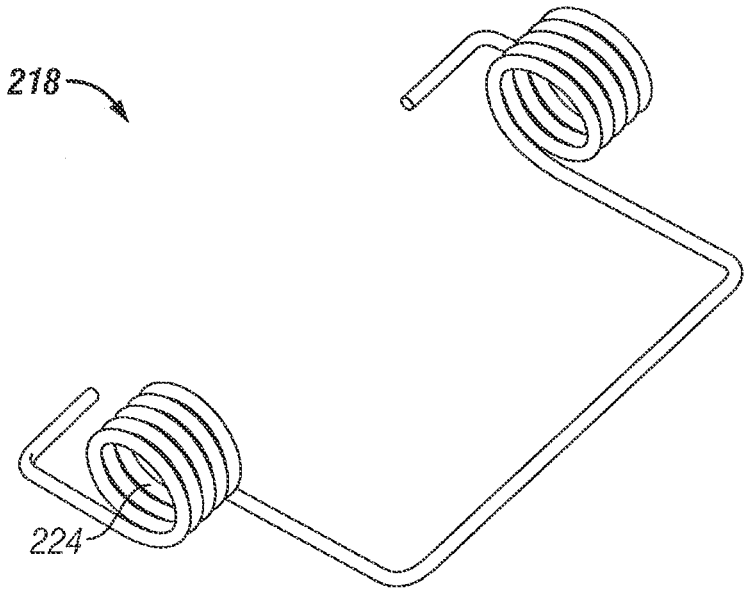
FIG. 17 is a view of an embodiment of a spring.

FIGS. 14*a* and 14*b* depict one form of the slide cam 172 which includes a slide cam surface 206 that is used to interact with the side 196 and slide cam engagement member 188 of the center cam 70, the interaction of which determines the motion of the slide cam 172 when the center cam 70 is rotated. For example, when the side 196 engages the slide cam surface 206 movement of the slide cam 172 relative to the rotation axis of the center cam 70 is accomplished. When, however, the center cam 70 is further rotated and the curved portion 194 engages the slide cam surface 206, little to no movement of the slide cam 172 may occur relative to the axis of rotation depending on the relative shape of the interference between the slide cam surface 206 and the curved portion 194. The slide cam surface 206 is in the form of an arc in the illustrated embodiment but can take other forms in different embodiments.

The slide cam 172 can include a catch 208 to receive a latch coupled with the boost cam 170. The catch 208 can take a variety of forms and in the illustrated embodiment is in the form of a wall forming an acute angle with surface 210 of the slide cam 172.

Figure 18:
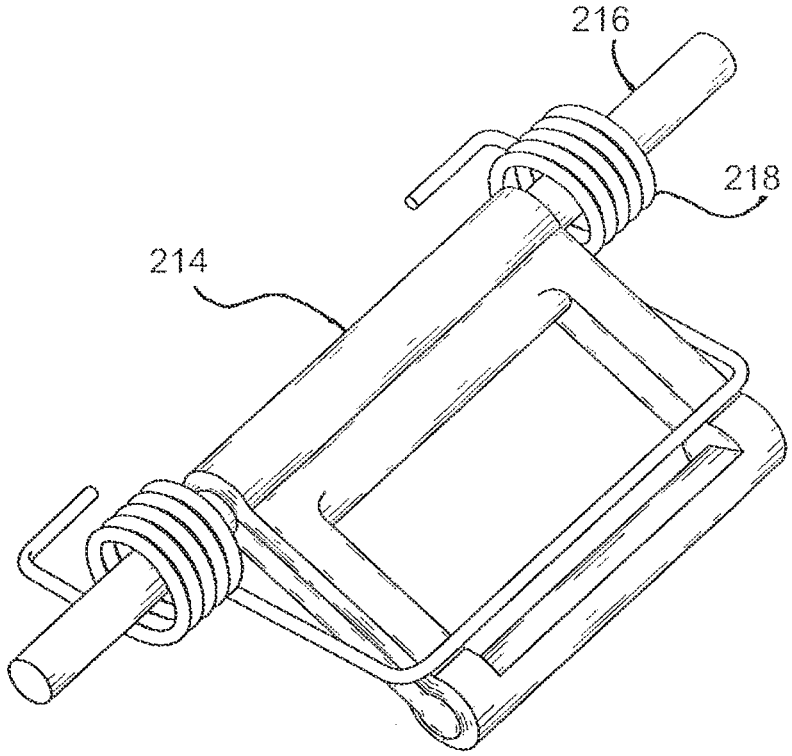
FIG. 18 is a view of an embodiment of latch.

FIGS. 15*a*, 15*b*, 16, and 17 illustrate components used to form the latch 212 that can be used to couple the boost cam 170 to the slide cam 172. The latch 212 includes a movable member 214, a pin 216 upon which the movable member 214 can pivot, and a spring 218. The movable member 214 includes an aperture 220 through which the pin 216 can be received and includes a shape that permits the pin 216 to be received in the formation 204 of the boost cam 170. The movable member 214 also Includes an engagement portion 222 used to interact with the catch 208. The spring in the illustrated embodiment also includes an aperture 224 through which the pin 216 can be received. FIG. 18 illustrates an integrated assembly of the latch 212 that is depicted apart from the boost cam 170.

Figure 19:
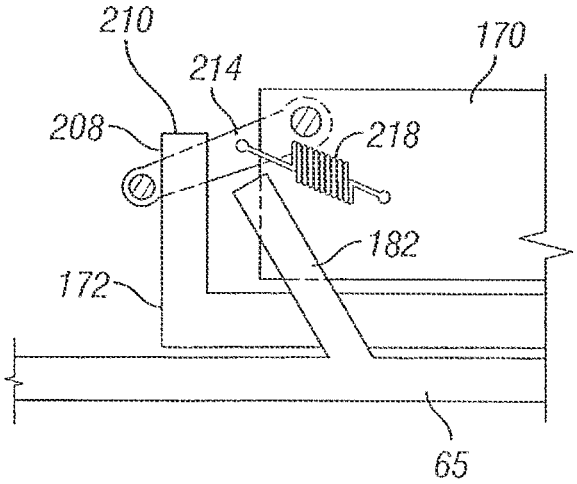
FIG. 19 is a view of an embodiment of a power boost assembly.

FIG. 19 depicts a schematic of one embodiment in which the boost cam 170 can be coupled to the slide cam 172 through the use of the latch 212 and catch 208 such that both are encouraged to move together during some portion of operation of the power boost assembly 60. The latch 212 is pivotingly connected to the boost cam 170 and is structured to engage a portion of the slide cam 172. The latch 212 can be biased using the spring 218 in a direction to encourage engagement with the catch 208 when the boost cam 170 reaches a position relative to the slide cam 172 that permits engagement. In some forms the latch 212 can ride on a surface 210 as the boost cam 170 moves toward the catch 208 whereupon the latch 212 engages the catch 208 at a relative position between the two. The latch 212 and catch 208 can each take a variety of forms some of which have been described herein. Any number of catches and latches can be used in the power boost assembly 60. Though the latch 212 and catch 208 are associated with each of the boost cam 170 and slide cam 172, respectively, it will be understood that many different configurations of the catch and latch are contemplated. Furthermore, other types of devices can also be used to couple the boost cam 170 and slide cam 172 as a function of door position.

A trigger 182 with the base 65 can be used to de-latch the latch 212 such that the boost cam 170 and slide cam 172 are free to move independent from one another. The trigger 182 is shown as being fixed relative to the base 65 and is used to urge the latch 212 to decouple from the catch 208. Various arrangements of the latch 212 and trigger 182 are contemplated herein other than the illustrated embodiment. To set forth just one non-limiting example, the latch 212 can be coupled to the slide cam 172 in some forms and structured to engage the boost cam 170. Further description of the latch 212 and trigger 182 will be described further below.

Figure 20:
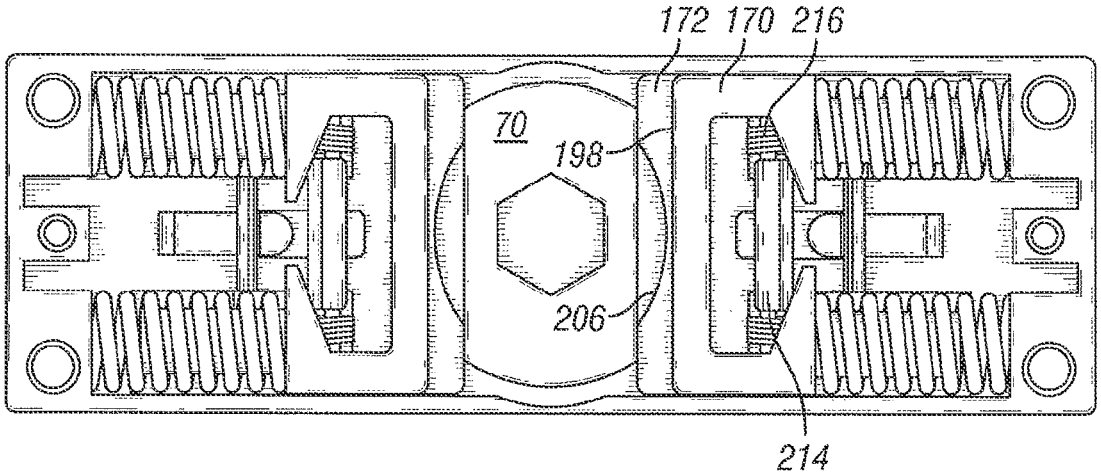
FIG. 20 is a view of an embodiment of a power boost assembly at a door position.
Figure 21:
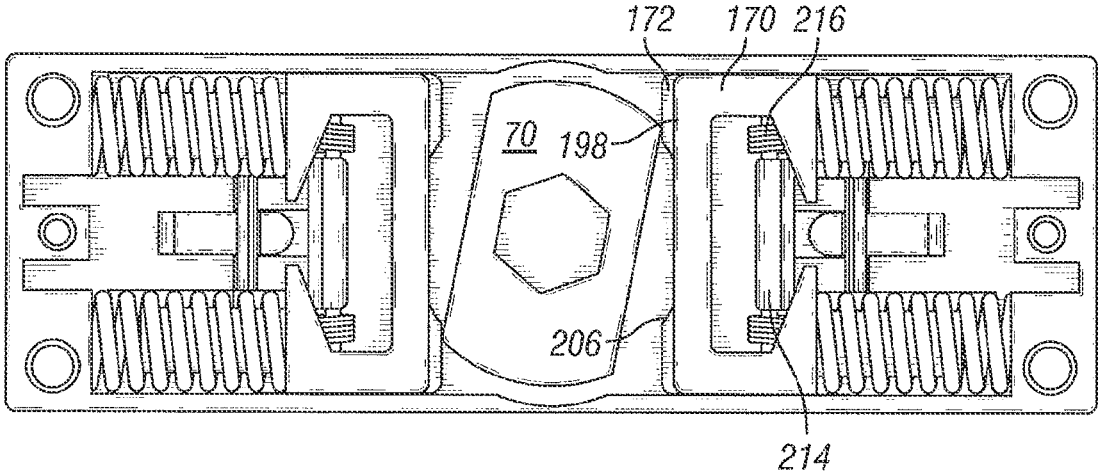
FIG. 21 is a view of an embodiment of a power boost assembly at a door position.

To describe operation of the power boost assembly 60, one non-limiting embodiment will be illustrated in FIGS. 20-25, each figure representing a different door opening and pinion rotation. Turning first to FIG. 20, the embodiment depicts the power boost assembly 60 at a door closed position. For ease of description the power boost assembly 60 will be assumed to be attached to a non-handed closer on the free pinion via a bolt that draws the power boost assembly 60 toward the door closer 15. FIG. 21 represents an initial movement of the door to a 4 degree opening position and the pinion is at 12 degrees of rotation. When the door 10 rotates, which causes motion of the linkage 45 discussed above, the pinion 40 likewise rotates causing the center cam 70 to rotate in turn. When the center cam 70 rotates the slide cam engagement member 188 engages the slide cam 172 causing it to move toward an end of the base 65. In one form the movement of the slide cam 172 caused by interaction with the slide cam engagement member 188 can occur over the first 8-10 degrees of door movement at which time the slide cam surface 206 receives curved portion 194 of the center cam 70 thus halting further movement of the slide cam 172 caused by the center cam 70. In the illustrated embodiment the first 8-10 degrees of movement are in the door opening direction, but other embodiments need not be limited to this direction as such.

Figure 22:
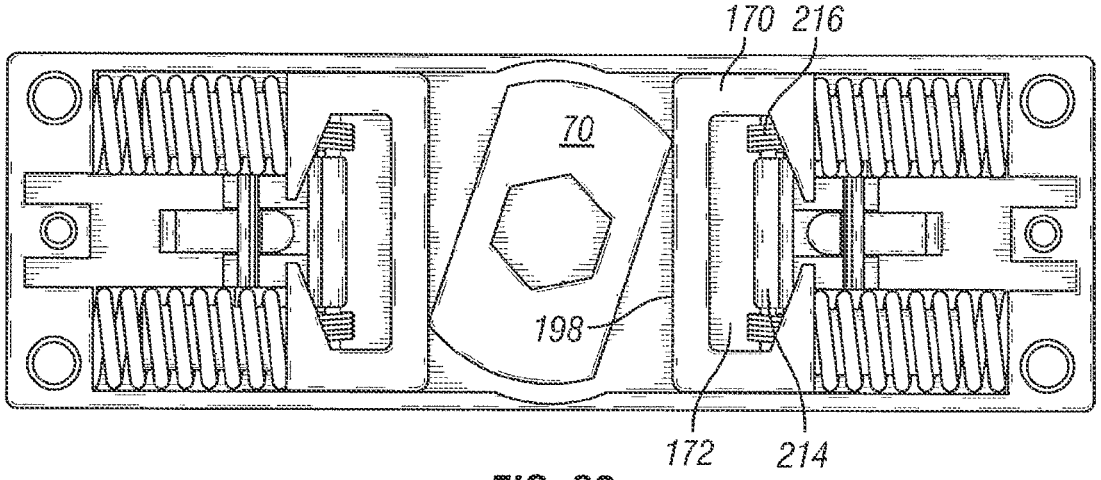
FIG. 22 is a view of an embodiment of a power boost assembly at a door position.

FIG. 22 depicts the door at a 7 degree opening position that corresponds to a pinion rotation of 19 degrees.

Figure 23:
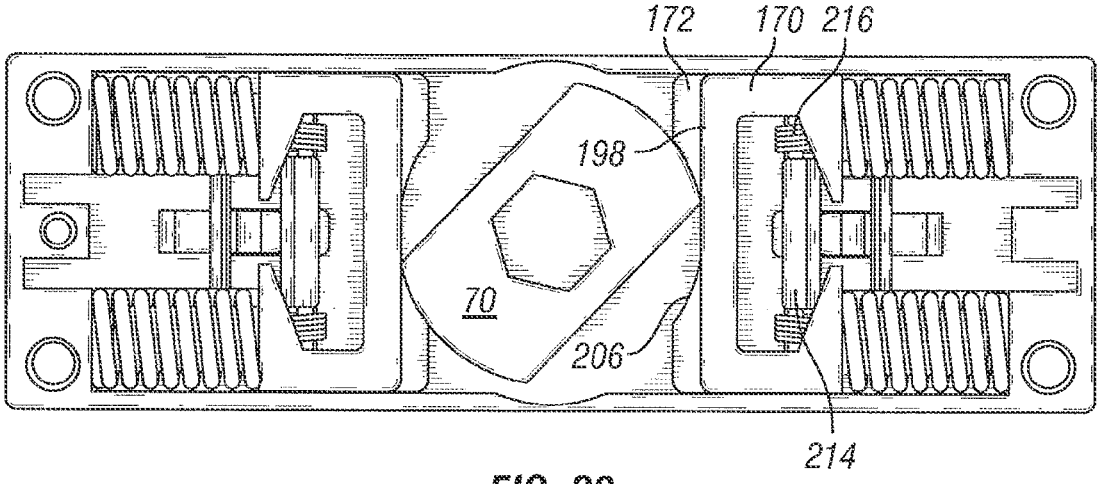
FIG. 23 is a view of an embodiment of a power boost assembly at a door position.
Figure 24:
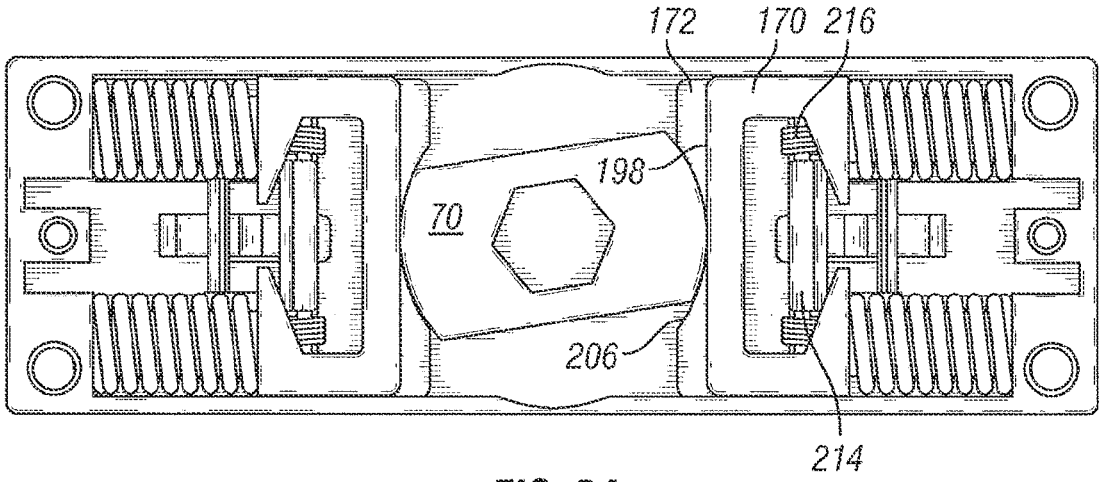
FIG. 24 is a view of an embodiment of a power boost assembly at a door position.
Figure 25:
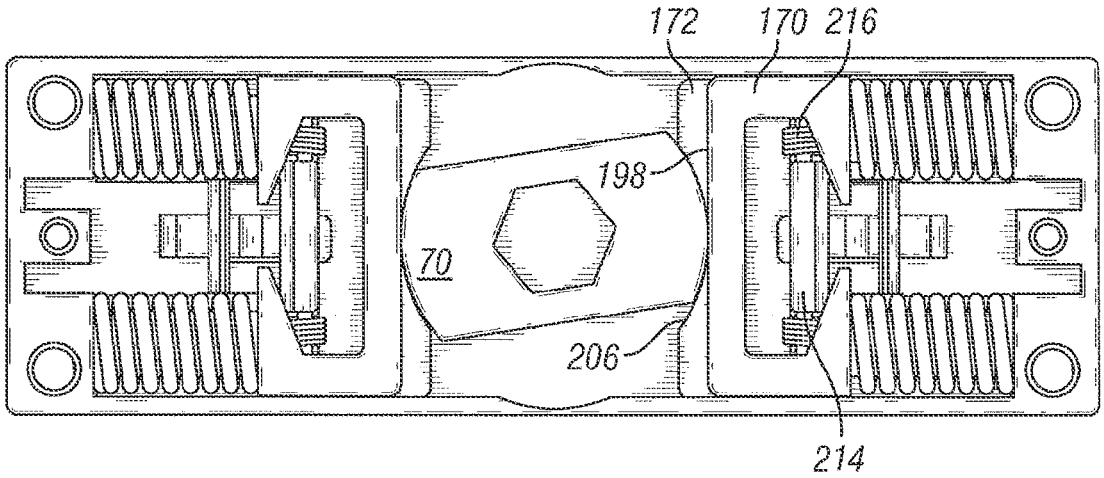
FIG. 25 is a view of an embodiment of a power boost assembly at a door position.

At about the same position that the slide cam 172 engages the curved portion 194 of the center cam 70, the outer portion of the center cam 70 that includes the curved portion 192 engages the boost cam 170 and causing it to move relative to the axis of rotation of the center cam 70. FIG. 23 illustrates such an arrangement where the door is in a 25 degree opening position and the pinion is at about 47 degrees of rotation. At this configuration the energy storage assembly 75 is being used to store energy as a result of the boost cam 170 movement. In one form the boost cam 170 can be moved relative to the axis of rotation of the center cam 70 until about 60 degrees of door movement in one embodiment at which point the boost surface 198 engages the curved surface 192 of the center cam 70 thus halting further build up of energy in the energy storage assembly 75. At or about the same time that the boost cam 170 no longer builds an energy in the energy storage assembly 75 the latch 212 engages the catch 208 to couple the boost cam 170 and slide cam 172 to move together. In the illustrated embodiment of FIG. 24, the door is at 55 degrees of opening position and the pinion is at about 80 degrees of rotation which in the illustrated embodiment corresponds to a position where the latch 212 engages the catch 208. FIG. 25 illustrates a door opening of 70 degrees and a pinion rotation of about 95.6 degrees.

When the door direction is reversed, the protrusion 186 of the center cam 70 begins to withdraw from the boost cam 170, but because the boost cam is latched to the slide cam 172, and because the slide cam 172 remains on the curved surface 194 of the center cam 70 thus preventing relative movement, the boost cam 170 likewise remains in place and the energy in the energy storage assembly 75 remains substantially the same.

When the door approaches the point at which the slide cam 172 engages side 196 from the outer portion 194 of the center cam 70 and subsequent relative motion is permitted, the energy built up in the energy storage device is imparted to the slide cam 172 via the latch 212 and the slide cam 172 therefore urges against the protrusion 188 of the center cam 70 causing a torque and thus power boost to the door. The power built up by the energy storage assembly 75 over a range of motion that caused the boost cam 170 to move is thus released at least in part through the slide cam 172 over the range of motion of the slide cam 172. In the embodiment described above it can be described as thus: power build up from about 8-10 degrees to 60 degrees during a door opening; power draw down from about 8-10 degrees to zero during a door closing. Various other ranges of power build up and power draw down are contemplated herein.

Figure 26:
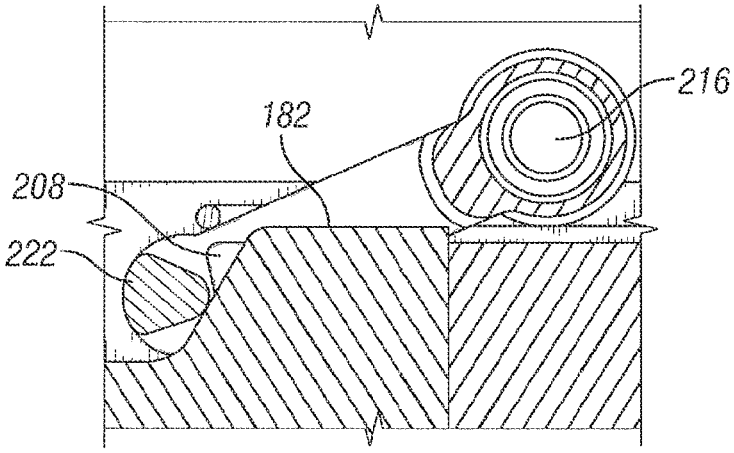
FIG. 26 is a view of an embodiment of a power boost assembly.

FIG. 26 illustrates another embodiment of the latch, catch, and trigger portion of the power boost assembly. The shape of the trigger 182, the catch 208, and the catch 208 promote decoupling of the boost cam 170 and slide cam 172 when the center cam 70 is rotated to a dosed position.

The embodiments of the power boost assembly 60 described above can be coupled with doors and door closers in a variety of manners. In some applications the power boost assembly can be removably affixed to a door and/or door closer to provide a power boost over a range of motion of a door. Any portion of the power boost assembly can be affixed to the door and/or door closer. For example, an outer surface of the base, cover, or both can be used to engage a surface of the door and/or door closer. The outer surface of the base, cover, or both can be coupled to a receiving surface of the door and/or door closer such as but not limited to a corresponding outer surface of the door and/or door closer. In some applications the power boost assembly can be integrated with a door closer such as to form a package. In other embodiments the power boost assembly can be modular and capable of being readily affixed to, and possibly removed from, an existing door and/or door closer with minimal maintenance activity. For example, in some situations a pre-installed door and door closer may have insufficient force to complete a door latching sequence. A power boost assembly can be coupled with the door and/or door closer to provide sufficient power to complete the door latch. Various other forms, combinations, etc are contemplated herein.

One aspect of the present application provides an apparatus comprising a door actuator having pinion configured to be attached to an arm of a door and rotatable about a pinion axis, the pinion capable of transmitting a power to open and close the door, the door actuator further having: a door actuator spring structured to store an energy from the pinion when the door is opened, a main cam configured to rotate with the pinion, and an energy storage device and release member in a work communication with the main cam structured to store an energy in the energy storage device upon a first rotation of the main cam and release a stored energy from the energy storage device through operation of the release member upon a second rotation of the main cam.

One feature of the present application further includes a release cam in a cam-cam follower relationship with the main cam and configured to deliver energy from the energy storage device to the main cam when the release member is operated to release the stored energy.

Another feature of the present application provides wherein rotation of the main cam above a first orientation ceases to cause motion in the release cam.

Yet another feature of the present application further includes an energy storage cam in a cam-cam follower relationship with the main cam, the energy storage cam configured to deliver energy from the main cam to the energy storage device.

Still another feature of the present application provides wherein the release member includes a coupled position to engage the energy storage cam to the release cam, and a release position to disengage the energy storage cam to the release cam.

Yet still another feature of the present application provides wherein the first rotation is different than the second rotation.

A further feature of the present application provides wherein the door closer includes a rack and pinion mechanism, and which further includes a damper configured to modulate a return force received from the door actuator spring to the pinion, wherein the damper is a fluid filled damper.

A still further feature of the present application provides wherein the main cam, energy storage device, and the release member are packaged in a modular device, the door actuator including the door actuator spring and pinion is a packaged assembly, and wherein the modular device is attached to the packaged assembly.

Another aspect of the present application provides an apparatus comprising a door closer having an actuation member that receives and imparts a power to a door, the door closer including a spring and damper, and a power boost assembly having a main cam in moveable relationship with the actuation member and having an energy storage device capable of storing an energy received from movement of the main cam over a first range of the main cam and an actuator configured to release the energy from the energy storage device over a second range of the main cam.

One feature of the present application provides wherein the main cam rotates about a pinion axis and wherein the actuator is a spring loaded latch configured to secure an energy stored in the energy storage device until the spring loaded latch is manipulated to release the energy from the energy storage device.

Another feature of the present application provides wherein the main cam includes a first cam surface configured to interact with a first cam and a second cam surface configured to interact with a second cam, a first interface defined between the first cam surface and the first cam and a second interface defined between the second cam surface and the second cam.

Yet another feature of the present application provides wherein the first cam is structured to deliver energy to the energy storage device according to the first interface, the second cam is structured to deliver energy to the main cam from the energy storage device according to the second interface when the actuator Is used to release the energy over the second range of the main cam.

Still another feature of the present application provides wherein the actuator is configured to permit independent movement of the first cam and second cam during the first range of motion, and wherein the actuator is configured to couple the first cam to the second cam during the second range of the main cam.

Still yet another feature of the present application provides wherein the power boost assembly is a modular package attached to the door closer.

A further feature of the present application provides wherein the power boost assembly is releasably attached to the modular package.

Still another aspect of the present application provides an apparatus comprising a door closer device having a rotatable actuator adapted to interact with a door, a first cam structured to rotate with the rotatable actuator and structured to deliver an energy to an energy storage device, a second cam structured to convey an energy from the energy storage device to the rotatable actuator, and means for triggering the first cam to be released from the second cam.

A feature of the present application further includes means for coupling the first cam to the second cam.

Yet still another aspect of the present application provides a method comprising moving a door to compress a spring in a door closer device, rotating a pinion as a result of moving the door, conveying an energy to a power boost energy storage device during a first motion of the door via a first actuation member in communication with the pinion, and delivering a torque provided by the energy in the power boost energy storage device through a second actuation member to the pinion as a result of a second motion of the door.

A feature of the present application further includes coupling the first actuation member to a second actuation member.

Another feature of the present application provides wherein the coupling includes securing an attachment member between the first actuation member and the second actuation member.

Still another feature of the present application further includes triggering a release of the first actuation member from the second actuation member.

Yet still another feature of the present application provides wherein the conveying an energy occurs by rotation of a cam in power communication with the first actuation member.

Still yet another feature of the present application provides wherein the delivering a torque includes imparting a load to the pinion over the second motion of the door that is shorter than the first motion of the door.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A method comprising:

attaching a power boost assembly to an existing door closer device comprising a housing, a pinion extending out of the housing, and a spring seated within the housing and engaged with the pinion, wherein the power boost assembly comprises a driver, an energy storage device, a first actuation member, and a second actuation member, and wherein attaching the power boost assembly to the door closer device includes coupling the driver to a portion of the pinion located outside the housing;

moving a door to compress the spring of the door closer device;

rotating the pinion as a result of moving the door;

conveying an energy to the energy storage device during a first motion of the door via the first actuation member; and delivering a torque provided by the energy in the energy storage device through the second actuation member to the pinion as a result of a second motion of the door in a direction different than that of the first motion.

2. The method of claim 1, which further includes coupling the first actuation member to the second actuation member.

3. The method of claim 2, wherein the coupling includes securing an attachment member between the first actuation member and the second actuation member.

4. The method of claim 2, which further includes triggering a release of the first actuation member from the second actuation member.

5. The method of claim 1, wherein the conveying the energy occurs by rotation of a cam in power communication with the first actuation member.

6. The method of claim 1, wherein the delivering the torque includes imparting a load to the pinion over the second motion of the door, wherein a range of the first motion over which the energy is conveyed to the power boost energy storage device is greater than a range of the second motion over which the load is imparted to the pinion.

7. A method comprising:

attaching a power boost assembly to a door closer device comprising a housing, a spring seated within the housing, and a pinion rotatably mounted in the housing and engaged with the spring, wherein an end portion of the pinion extends out of the housing, wherein the power boost assembly comprises a driver and an energy storage device, and wherein attaching the power boost assembly to the door closer device includes coupling the end portion of the pinion with the driver;

moving a door to compress the spring of the door closer device;

rotating the pinion as a result of the moving of the door;

conveying an energy to the energy storage device during a first motion of the door via rotation of the pinion and storing the energy in the energy storage device for subsequent use; and releasing at least a portion of the energy from the energy storage device and transmitting a torque provided by the at least a portion of the energy to the pinion via the driver as a result of a second motion of the door in a direction different than that of the first motion.

8. The method of claim 7, wherein the conveying of the energy to the energy storage device during the first motion of the door occurs via a first actuation member in communication with the pinion; and wherein the transmitting of the torque occurs via transmission through a second actuation member to the pinion as a result of the second motion of the door.

9. The method of claim 8, further comprising coupling the first actuation member to the second actuation member.

10. The method of claim 9, wherein the coupling includes securing an attachment member between the first actuation member and the second actuation member.

11. The method of claim 9, further comprising triggering a release of the first actuation member from the second actuation member.

12. The method of claim 8, wherein the conveying the energy occurs by rotation of a cam in power communication with the first actuation member.

13. The method of claim 7, wherein the delivering the torque includes imparting a load to the pinion over the second motion of the door, wherein a range of the first motion over which the energy is conveyed to the power boost energy storage device is greater than a range of the second motion over which the load is imparted to the pinion.

14. A method comprising:

providing a door actuator having a pinion configured to be attached to an arm of a door and rotatable about a pinion axis, the pinion capable of transmitting a power to open and close the door, the door actuator further including a first housing, and a spring seated in the first housing and engaged with the pinion, wherein the pinion has an end portion located outside of the first housing;

providing a power boost assembly comprising a second housing, a driver rotatably mounted in the second housing, and an energy storage device mounted in the second housing and engaged with the driver;

attaching the power boost assembly to the door actuator, wherein attaching the power boost assembly to the door actuator includes inserting the end portion of the pinion into an opening in the driver, thereby rotationally coupling the driver with the pinion and placing the pinion in power communication with the energy storage device;

moving the door to compress the spring;

rotating the pinion as a result of the moving of the door;

conveying an energy to the energy storage device during a first motion of the door via rotation of the pinion and storing the energy in the energy storage device for subsequent use; and releasing at least a portion of the energy from the energy storage device and transmitting a torque provided by the at least a portion of the energy to the pinion as a result of a second motion of the door in a direction different than that of the first motion.

15. The method of claim 14, wherein the conveying of the energy to the energy storage device during the first motion of the door occurs via a first actuation member in communication with the pinion; and wherein the transmitting of the torque occurs via transmission through a second actuation member to the pinion as a result of the second motion of the door.

16. The method of claim 15, further comprising coupling the first actuation member to the second actuation member.

17. The method of claim 16, wherein the coupling includes securing an attachment member between the first actuation member and the second actuation member.

18. The method of claim 15, further comprising triggering a release of the first actuation member from the second actuation member.

19. The method of claim 14, wherein the conveying the energy occurs by rotation of a cam in power communication with the first actuation member.

20. The method of claim 14, wherein the delivering the torque includes imparting a load to the pinion over the second motion of the door, wherein a range of the first motion over which the energy is conveyed to the power boost energy storage device is greater than a range of the second motion over which the load is imparted to the pinion.

* * * * *